United States Patent [19]

Carter, Sr.

[11] 4,282,091

[45] Aug. 4, 1981

[54] PEANUT SEPARATOR

[75] Inventor: Lewis M. Carter, Sr., Donalsonville, Ga.

[73] Assignee: Lewis M. Carter Mfg. Co., Inc., Donalsonville, Ga.

[21] Appl. No.: 83,412

[22] Filed: Oct. 10, 1979

[51] Int. Cl.[3] ..... B03B 4/00

[52] U.S. Cl. ..... 209/467; 209/486; 209/496; 209/502; 209/504

[58] Field of Search ..... 209/467, 469, 486, 491, 209/494–496, 502, 504

[56] References Cited

U.S. PATENT DOCUMENTS

| | | | |
|---|---|---|---|
| 1,105,912 | 8/1914 | Kirby | 209/494 X |
| 1,442,186 | 1/1923 | Sperry | 209/504 |
| 1,923,917 | 8/1933 | Davis | 209/494 X |
| 2,273,296 | 2/1942 | Stump | 209/495 X |
| 2,449,582 | 9/1948 | Brusset | 209/469 X |

*Primary Examiner*—Ralph J. Hill

*Attorney, Agent, or Firm*—B. J. Powell

[57] ABSTRACT

This application discloses a separator for separating granular materials according to specific weight including an air permeable reciprocatory deck for supporting a bed of the granular material thereon and defining an elongate discharge opening therefrom through which a certain separated fraction of the granular material is to be discharged after separation; a fan forcing air upwardly through the air permeable deck and the bed of granular material carried on the deck to fluidize the bed and cause the granular material in the bed to separate according to the specific weight thereof as the deck is reciprocated; and a pneumatic pressure operated gate selectively covering the discharge opening so as to selectively control the flow of the granular material therethrough in response to the pneumatic pressure in said bottom air plenum with the gate selectively varying the effective length and height of the opening in response to the pneumatic pressure below the deck.

9 Claims, 16 Drawing Figures

FIG 9
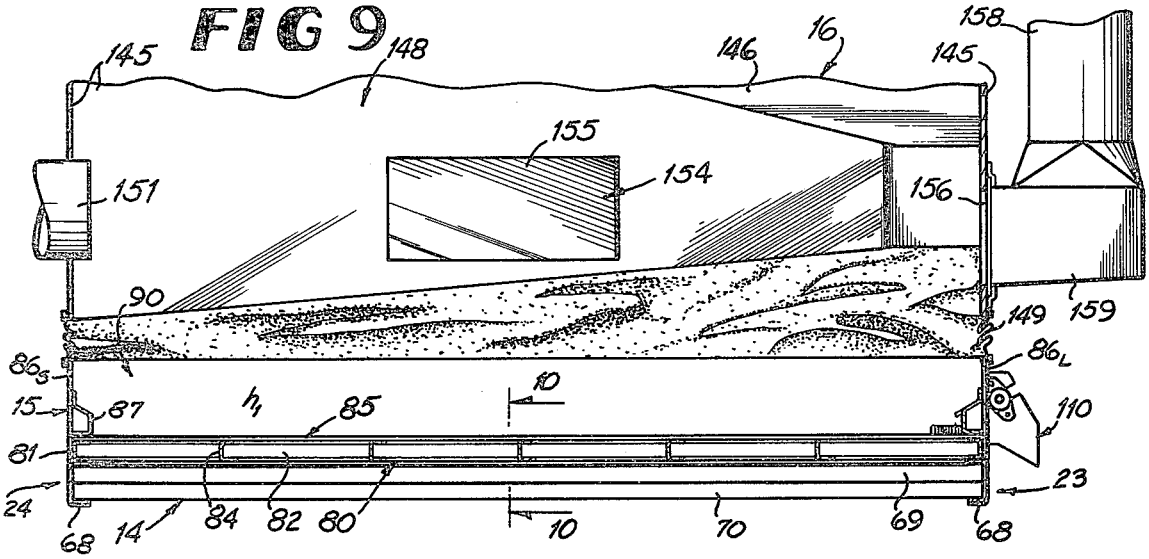
FIG 10
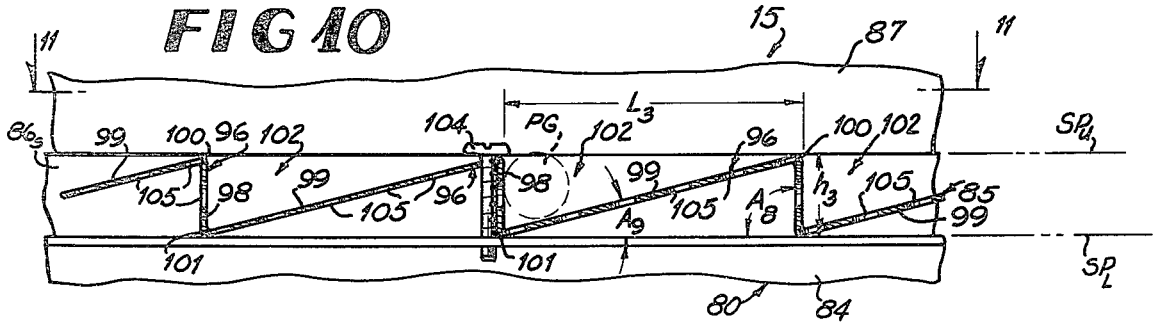
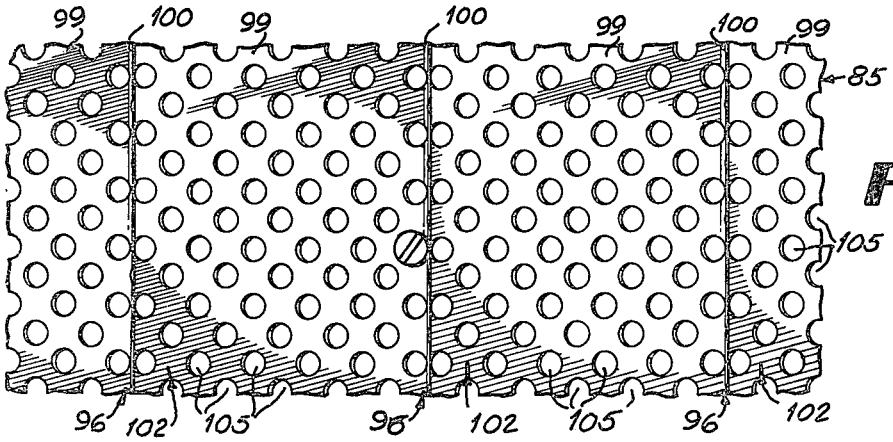
FIG 11

PEANUT SEPARATOR

BACKGROUND OF THE INVENTION

Separatory devices have been used for many years to separate granular materials such as peanuts, coffee beans, various grains, minerals and the like according to specific weight. Such separator devices are commonly referred to in the industry as gravity separators and discharge the granular material onto a tilted, vibrating deck with a perforate bottom through which air is forced upwardly through the granular material. The upward air flow through the bed of granular material on the deck fluidizes the bed and causes the granular material to stratify according to the different specific weights of the pieces of material. The vibratory action of the deck causes the bed of granular material to shift along the deck and, when combined with the tilt of the deck, causes the different specific weight fractions in the bed of granular material to accumulate at different positions along the edges of the deck so that the accumulated fractions can be separated.

Some types of prior art separators have a relatively high tilt angle such that the granular material makes a single pass across the deck for separation. Another type of prior art separator uses a relatively low tilt angle such that the granular material remains on the deck for a significantly longer period of time and circulates over the deck surface in several passes before being removed from the deck.

This latter type separator has a stepped screen which moves the material in the bottom of the bed generally along a first direction and controls the depth of the bed of material with a discharge gate of fixed length which is opened in response to the air pressure below the deck. In this type of separator, the acceptable specific weight range fraction of the material is sought to be removed through the pneumatically operated discharged gate. Because the gate opening was of fixed length, however, it did not recognize the fact that the length and height of the accumulated acceptable specific weight range fraction of the material on the deck varied. As a result, some of the granular material in the bed outside of the acceptable specific weight range was also sometimes discharged through the pneumatically operated discharge gate. Also, the angles of the steps in the screen sometimes failed to positively move the material along the screen so that the desired degree of separation was difficult to achieve.

SUMMARY OF THE INVENTION

These and other problems and disadvantages associated with the prior art are overcome by providing a pneumatic discharge gate assembly for a separator which opens in such a manner that the opening through which the accumulated fraction of the granular material in the acceptable weight range is discharged always remains in registration with that fraction even though the height and length of that fraction may vary. This is accomplished by varying the opening in the gate assembly both as to length and height as the gate assembly is opened. The greater height of the opening through the gate assembly is always located in the thicker portion of the accumulated fraction while the length of the opening is increased in a direction opposite that in which the accumulated fraction tends to be thicker so that, as the gate opening is increased as the accumulated fraction becomes thicker, the opening remains in registration with the desired accumulated fraction.

The apparatus of the invention includes an air permeable reciprocatory deck for supporting a bed of the granular material to be separated thereon and defining an elongate discharge opening therefrom through which a certain separated fraction of the granular material is to be discharged after separation; a fan for forcing air upwardly through said air permeable deck and the bed of granular material carried on the deck to fluidize the bed and cause stratification of the granular material in the bed according to the specific weight thereof; means for vibrating the deck to cause the material in the fluidized bed to accumulate in separated fractions of different specific weight ranges in different locations on the deck; and a discharge gate assembly selectively varying the effective size of the discharge opening to control the flow of the fraction of material accumulated at the discharge opening from the bed. The gate assembly varies both the effective height and length of the discharge opening always being greater at that end where the bed tends to be thicker and the effective length of the opening increases in a direction opposite to that in which the bed tends to be thicker. The gate assembly may be operated by a positioning mechanism responsive to the air pressure below the bed so that the effective size of the discharge opening is increased as the air pressure is increased due to increasing bed thickness.

These and other features and advantages of the invention will become more clearly understood upon consideration of the following specification and accompanying drawings wherein like characters of reference designate corresponding parts throughout the several views and in which:

BRIEF DESCRIPTION OF THE DRAWINGS

FIG. 9 is a transverse cross-sectional view of the deck assembly taken generally along line 9—9 in FIG. 8;

FIG. 10 is an enlarged cross-sectional view of the deck screen taken generally along line 10—10 in FIG. 9;

FIG. 11 is a top plan view of a portion of the deck screen taken generally along line 11—11 in FIG. 10;

Figure 1:
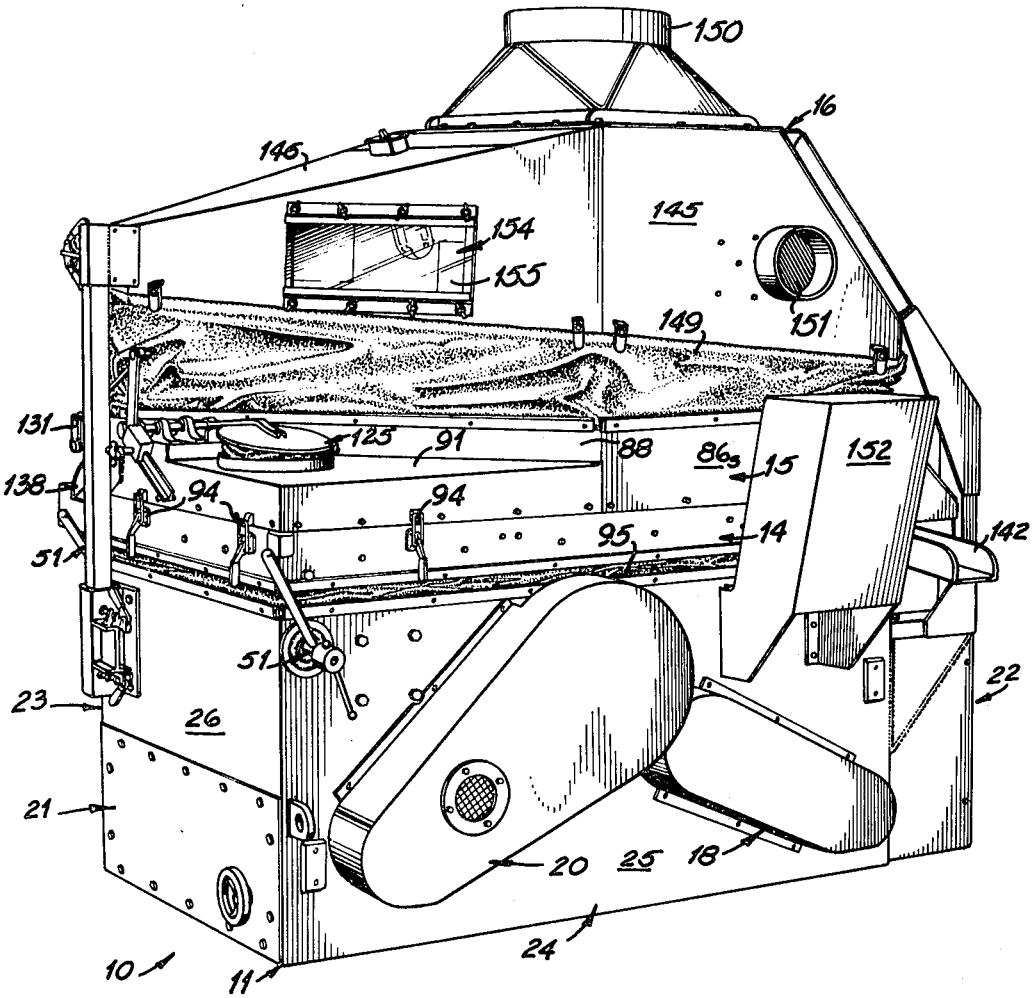
FIG. 1 is a perspective view of a separator embodying the invention.

These figures and the following detailed description disclose specific embodiments of the invention; however, it is to be understood that the inventive concept is not limited thereto since it may be embodied in other forms.

DETAILED DESCRIPTION OF ILLUSTRATIVE EMBODIMENTS

Referring to the figures, it will be seen that the separator 10 is used to separate granular materials using a combination of gravity, air flow and vibratory action. The separator 10 is specifically described as applied to granular materials such as peanuts but may likewise be applied to other granular materials such as grain, beans, minerals and the like.

The separator 10 includes generally a housing assembly 11 (FIGS. 1–7) which mounts a vibratory frame assembly 12 (FIGS. 5–7) therein. The vibratory frame assembly 12 mounts a subdeck assembly 14 thereon (FIGS. 1–7) which in turn mounts a deck assembly 15 thereon (FIGS. 1–7). A hood assembly 16 (FIGS. 1–4) is carried by the housing assembly 11 and is positioned above the deck assembly 15. A lower fan unit 18 (FIGS. 6–7) is carried in housing assembly 11 to direct an upward air flow through the deck assembly 15 and an upper fan unit 19 (FIGS. 3 and 4) is connected to the hood assembly 16 to withdraw air therefrom. A vibratory drive unit 20 is mounted in housing assembly 11 to vibrate frame assembly 12 and thus the subdeck assembly 14 as well as deck assembly 15.

For sake of clarity, the near end of the separator 10 as seen in FIG. 1 will be referred to as the primary discharge end 21 and the distal end will be referred to as the secondary discharge end 22. The distal side as seen in FIG. 1 will be referred to as the discharge side 23 while the near side will be referred to as the off side 24. This same convention will be used for each of the assemblies of the separator and this particular terminology will become more apparent.

The material to be separated is placed on the deck assembly 15 where the air, gravity and vibratory action causes the material to stratify into levels according to the specific gravity of the pieces of material. In the separator 10 illustrated, the stratified material is separated into a first fraction of an acceptable specific weight range, a second fraction of a specific weight range lighter than the first fraction, and a third fraction of a specific weight range heavier than the first fraction. More ranges could be used; however, these three ranges have been found satisfactory for granular materials such as peanuts.

Figure 5:
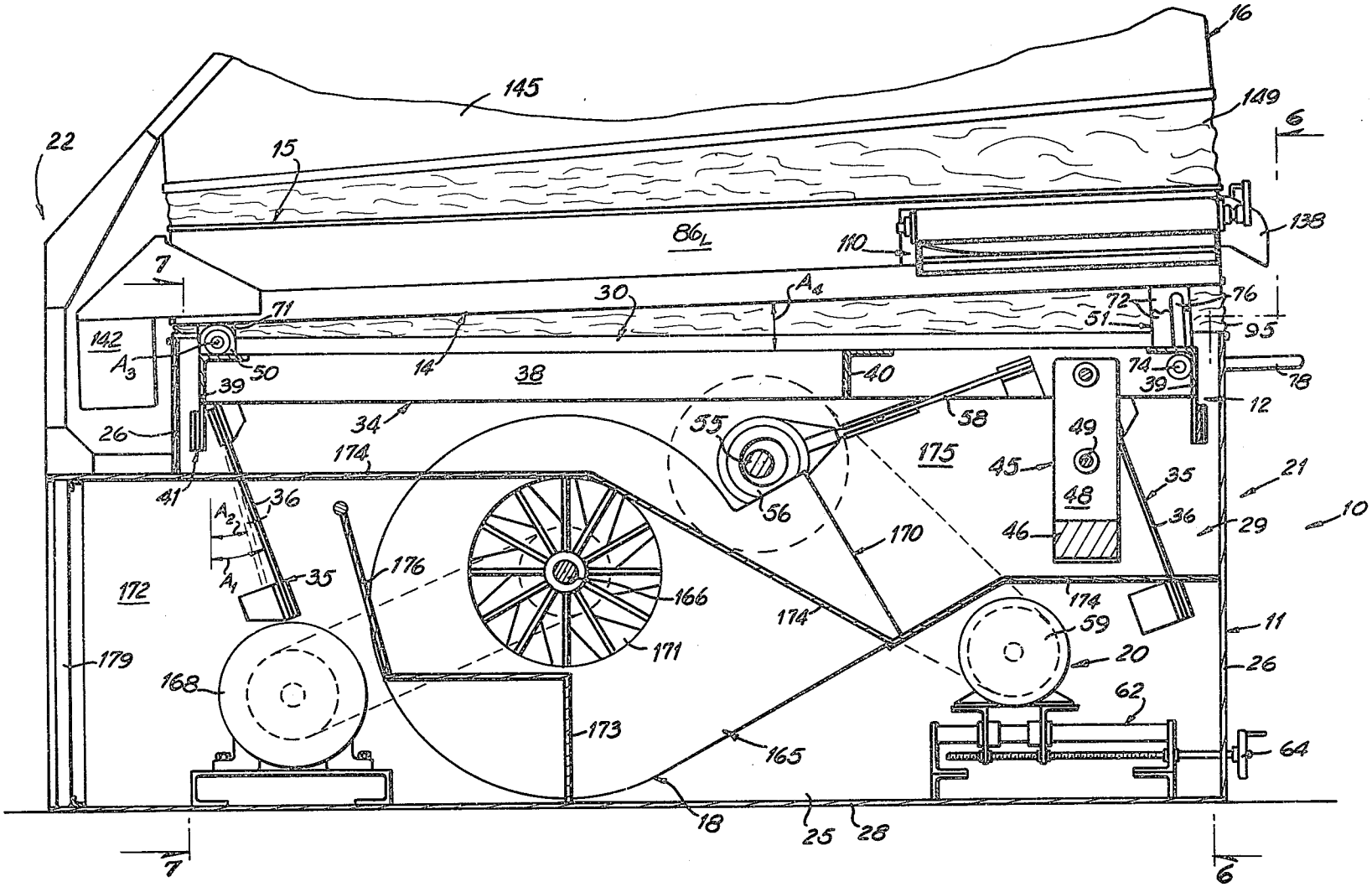
FIG. 5 is a longitudinal cross-sectional view taken generally along line 5—5 in FIGS. 3 and 4.

Housing assembly 11 is generally rectilinear in shape with an open top. The housing assembly 11 includes opposed side walls 25 which are connected together by opposed end walls 26 with its bottom closed by bottom wall 28 (FIG. 5). As best seen in FIG. 5, the top of the housing assembly 11 is open as indicated at 30 with the walls 25, 26 and 28 forming an open top chamber 29 therein. The housing assembly 11 serves both to mount the other components of the separator 10 as well as directing the air flow upwardly through the deck assembly 15 as will become more apparent.

VIBRATORY FRAME ASSEMBLY

Figure 6:
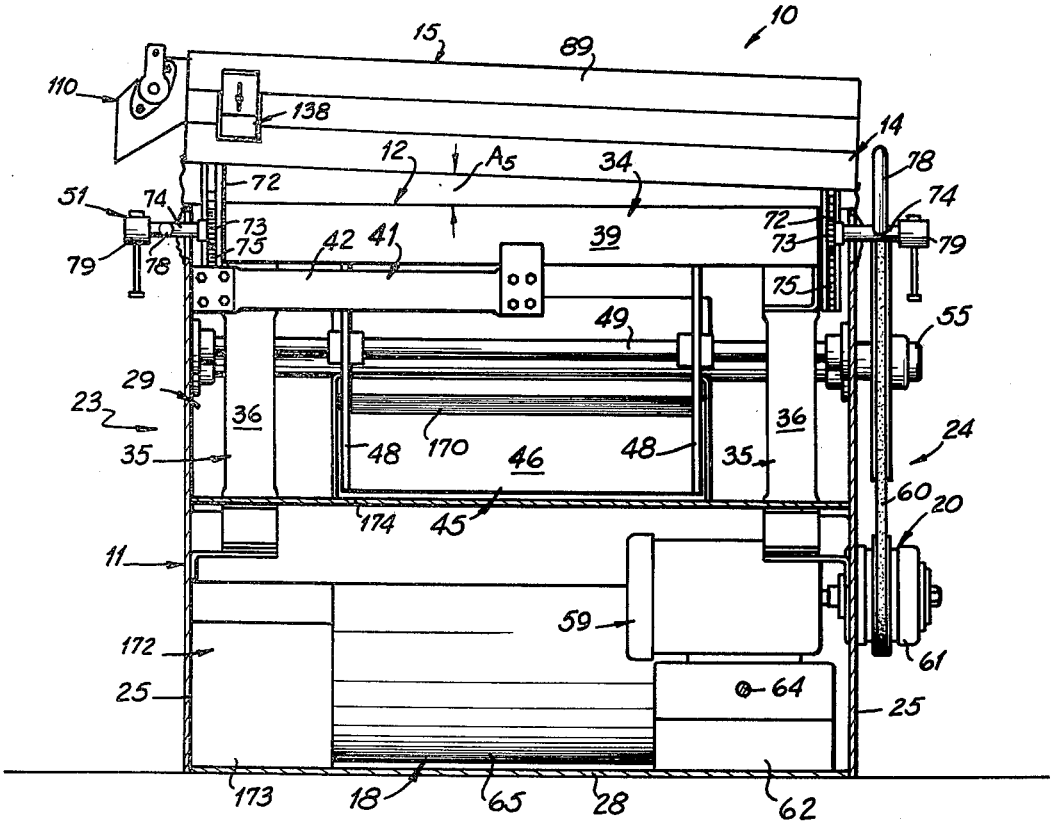
FIG. 6 is a transverse cross-sectional view taken generally along line 6—6 in FIG. 5.
Figure 7:
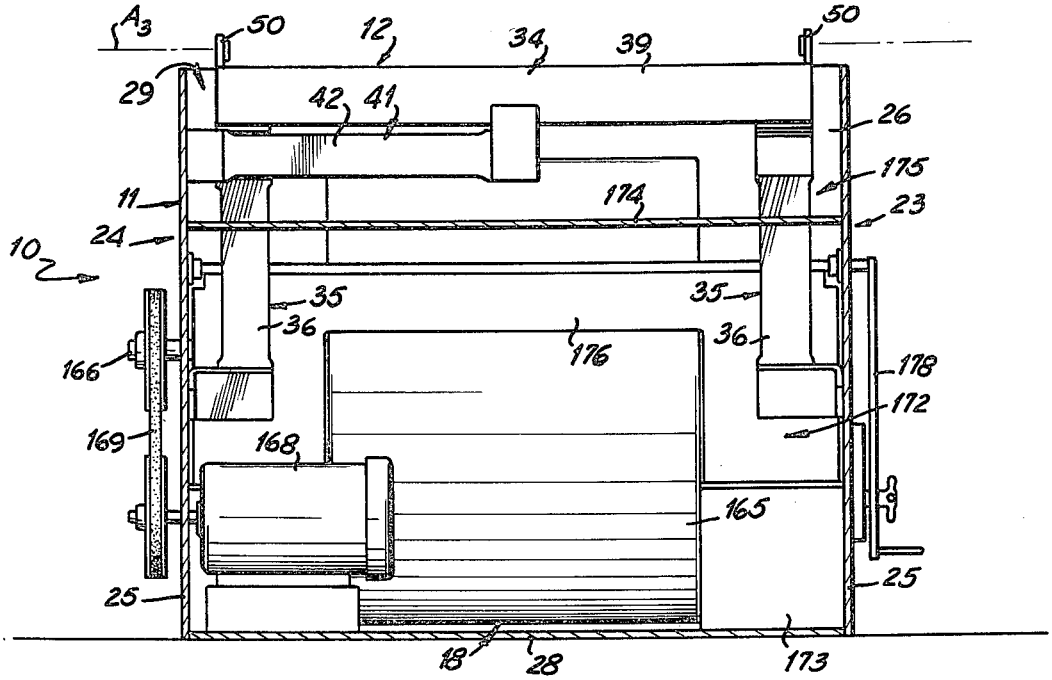
FIG. 7 is a transverse cross-sectional view taken generally along line 7—7 in FIG. 5.

The vibratory frame assembly 12 is best seen in FIGS. 5–7 and is mounted in the open top chamber 29 in the housing assembly 11. The vibratory frame assembly 12 includes a generally horizontally oriented, open support frame 34 mounted adjacent the top opening 30 of chamber 29 on side leaf spring assemblies 35 at the four corners of the support frame 34.

Each of the side leaf spring assemblies 35 includes a resilient fiberglass leaf spring 36 rigidly attached to the support frame 34 at its upper end and rigidly attached to the side walls 25 of housing assembly 11 at its lower end. While the leaf springs 36 are resilient, they have enough strength to support the frame 34. Each of the leaf springs 36 is generally vertically oriented under the side of the frame 34 when viewed from the ends of the separator as seen in FIGS. 6 and 7. When viewed from the side of the separator as in FIG. 5, it will be seen that each of the springs 36 angles upwardly and away from the primary discharge end (the right hand end in FIG. 5) of support frame 34. As the frame 34 is reciprocated along its longitudinal axis during vibration, this angling of leaf springs 36 causes the frame 34 to move slightly upwardly as it moves toward the primary discharge end of the separator and to move slightly downwardly as it moves toward the secondary end of the separator.

Three of the leaf springs 36 in the side leaf spring assemblies 35, when viewed as in FIG. 5, are angled away from the vertical at a common angle $A_1$. One of the leaf springs 36 adjacent the secondary discharge end of support frame 34 is angled away from the vertical at an angle $A_2$ as shown by the dashed line position in FIG. 5. Because angle $A_2$ is less than angle $A_1$, this particular corner of the support frame 34 moves up and down slightly less than the rest of the support frame 34 as will become more apparent.

The lateral motion of the support frame 34 is controlled by end leaf spring assemblies 41. The end leaf spring assembly 41 at the primary discharge end of the support frame 34 seen in FIG. 6 connects the end rail 39 with the housing side wall 25 on the discharge side of the separator 10 while the end leaf spring assembly 41 at the secondary discharge end of the support frame 34 seen in FIG. 7 connects the end rail 39 with the housing side wall 25 on the off side of the separator 10. Each of the end leaf spring assemblies 41 also has a resilient fiberglass leaf spring 42 similar to leaf springs 36. Leaf springs 42 are generally horizontally oriented when viewed from the ends of separator 10 as in FIGS. 6 and 7 so that they flex horizontally. Leaf springs 42 are generally transversely extending with respect to the longitudinal axis of frame 34 so that as frame 34 is moved and the leaf springs 42 flex, the primary discharge end of frame 34 is moved toward the discharge side of the separator while the secondary discharge end of the frame 34 is moved toward the off side of the separator.

It will thus be seen that reciprocatory vibration of support frame 34 generates a compound motion of frame 34 under the influence of leaf spring assemblies 35 and 41. Because the subdeck assembly 14 and deck assembly 15 are mounted on support frame 34, this compound motion is transmitted to these assemblies as will become more apparent.

The vibratory frame assembly 12 also includes a counterweight assembly 45 which is connected to the support frame 34 to offset the reaction forces generated as the support frame 34 is vibrated by the vibratory unit 20 as will become more apparent. The counterweight assembly 45 includes a counterweight 46 mounted between side frames 48 with the side frames 48 being pivoted between the opposed side walls 25 of the housing assembly 11 on support shaft 49. The ends of the side frames 48 opposite the counterweight 46 are pivoted to the side rails 38 on the support frame 34 so that movement of the support frame 34 in one direction causes movement of the counterweight 46 in the opposite direction to offset the reaction forces generated by the vibration of the support frame 34.

The secondary discharge end of the support frame 34 as seen in FIG. 5 is provided with a pair of upstanding pivot ears 50 to pivotally mount the subdeck assembly 14 thereon as will become more apparent. The primary discharge end of the support frame 34 as seen in FIG. 5 is provided with a pair of positioning assemblies 51 used to elevate the subdeck assembly 14 as will be more fully explained.

The vibratory drive unit 20 reciprocally vibrates frame 34 and includes generally an eccentric drive shaft 55 rotatably journalled between the side walls 25 of the housing assembly 11 so that the drive shaft 55 extends transversely of the longitudinal axis of the housing assembly 11. Eccentric bearing units 56 are mounted on the eccentric drive shaft 55 at opposite sides of the support frame 34 and are connected to the side rails 38 on the support frame 34 through flexible connectors 58 shown as fiberglass leaf springs. It will thus be seen that, as the eccentric drive shaft 55 is rotated, the eccentric bearing units 56 will cause the support frame 34 to be vibrated back and forth along its longitudinal axis while supported by leaf spring assemblies 35 and 41. The eccentric drive shaft 55 is rotatably driven by a vibratory drive motor 59 via belt 60 and variable speed pulley 61. The vibratory drive motor 59 is adjustably carried on mounting assembly 62 in housing assembly 11 so that the effective rotational speed of the eccentric drive shaft 55 can be adjusted by operating the positioning screw 64 on the mounting assembly 62.

SUBDECK ASSEMBLY

Figure 12:
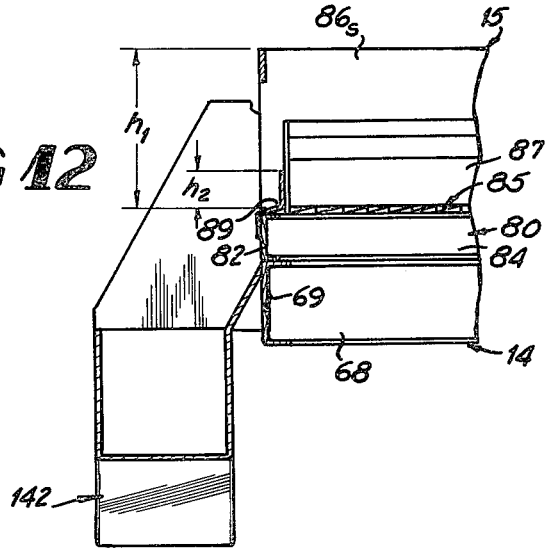
FIG. 12 is an enlarged cross-sectional view of the deck assembly taken generally along line 12—12 in FIG. 8.

The subdeck assembly 14 is best seen in FIGS. 5, 9 and 12. The subdeck assembly 14 is an open framework with a rectilinear size and shape corresponding to that of support frame 34 and includes a pair of opposed side members 68 joined at opposite ends by end members 69. Intermediate transversely extending members 70 connect the side members 68 intermediate their ends. This allows air to pass upwardly through the subdeck assembly 14. The subdeck assembly 14 has a construction which is sufficiently flexible to allow the subdeck assembly to be twisted along its longitudinal axis as will become more apparent.

The subdeck assembly 14 is provided with a pair of depending pivot ears 71 at its secondary discharge end which are pivoted on the pivot ears 50 on the support frame 34 to pivotally mount the secondary discharge end of the subdeck assembly to the support frame 34 about the transversely extending axis $A_3$. The primary discharge end of the subdeck assembly 14 is connected to the support frame 34 by the positioning assemblies 51 at opposite sides of the primary discharge end.

Each of the positioning assemblies 51 includes a positioning plate 72 pinned to the subdeck assembly 14. A pinion gear shaft 74 is rotatably journalled in side rail 38 of the support frame 34 and extends through an elongate slot 76 (FIG. 5) through positioning plate 72 so that plate 72 can be raised and lowered with respect to shaft 74. The pinion gear 73 on shaft 74 is maintained in driving engagement with a rack gear 75 (FIG. 6) mounted on the positioning plate 72 by the slot 76 in the positioning plate 72. Thus, as the handle 78 rotates the pinion gear shaft 74, the positioning plate 72 will be raised and lowered with respect to the support frame 34 to raise or lower that corner of the subdeck assembly 14 associated with the particular positioning assembly 51. Because the positioning assemblies 51 are independent of each other, each corner of the subdeck assembly 14 at its primary discharge end can be raised more than the other corner or vice versa. An appropriate locking mechanism 79 is provided on each of the positioning assemblies 51 to lock the position of the pinion gear shaft 74 as desired. Thus, the positioning assemblies 51 serve both to pivot the subdeck assembly 14 with respect to the support frame 34 about the pivot axis $A_3$ as seen in FIG. 5 while at the same time twisting the primary discharge end of the subdeck assembly 14 as seen in FIG. 6. Usually, the primary end of the subdeck assembly 14 is raised higher than its secondary discharge end so that subdeck assembly 14 is tilted upwardly at angle $A_4$ as seen in FIG. 5. Also, the primary discharge end of subdeck assembly 14 is raised higher at the discharge side than at the offside as seen in FIG. 6 so that the primary discharge end is tilted at angle $A_5$ as seen in FIG. 6. Because the secondary discharge end of subdeck assembly 14 is not tilted transversely of the longitudinal axis of the subdeck assembly, the transverse tilting of the primary discharge end at angle $A_5$ causes the subdeck assembly to be slightly twisted about its longitudinal axis.

DECK ASSEMBLY

Figure 8:
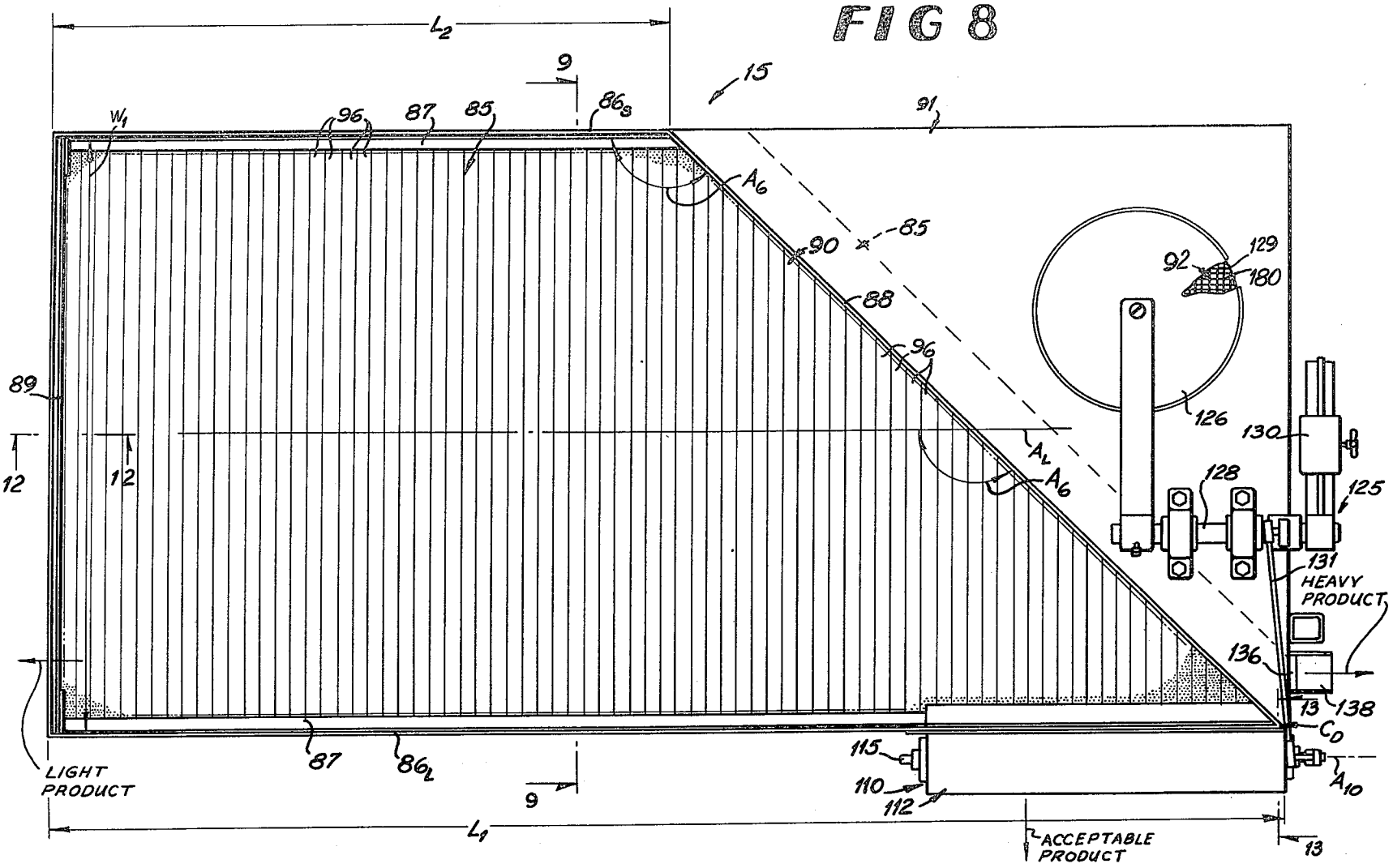
FIG. 8 is a top plan view of the separator deck assembly taken generally along line 8—8 in FIG. 2.

The deck assembly 15 is carried on top of the subdeck assembly 14. As best seen in FIGS. 8–12, the deck assembly 15 includes generally an open deck frame 80 with a rectilinear configuration corresponding in size to the subdeck assembly 14. The deck frame 80 has opposed side rails 81 (FIG. 9) parallel to the deck longitudinal axis $A_L$ (FIG. 8) joined at opposite ends by transversely extending end rails 82. Longitudinally extending, intermediate rails 84 extend between the end rails 82. The structure of the deck frame 80 is such that the deck frame can be twisted about its longitudinal axis $A_L$ as seen in FIG. 8 as the subdeck assembly 14 is twisted. The deck frame is sufficiently open for the air flowing up through subdeck assembly 14 to pass therethrough as will become more apparent.

The deck frame 80 mounts on the top side thereof a perforated screen 85 which serves to support the granular material deposited on the deck assembly 15 for separation. The perforated screen 85 will be defined in more detail hereinafter. Opposed, upstanding side walls 86 extend along opposite sides of the deck frame 80 parallel to the longitudinal axis $A_L$. The side wall $86_L$ on the discharge side of deck assembly 15 has a length $L_1$ about equal to the length of the deck assembly while the side wall $86_S$ on the off side of the deck assembly 15 is considerably shorter than side wall $86_L$. Both side walls $86_L$ and $86_S$ extend from the secondary discharge end of the deck assembly 15 toward the primary discharge end. Side wall $86_L$ extends all the way to the primary discharge end while the shorter side wall $86_S$ extends only part way. A banking wall 88 connects the end of the side wall $86_L$ at the primary discharge end with the end of the side wall $86_S$ facing the primary discharge end so that banking wall 88 is angled at angle $A_6$ (FIG. 8) with respect to the axis $A_L$ and with respect to the side wall $86_S$. Angle $A_6$ is illustrated at about 130° but different angles may be used. The side walls $86_L$ and $86_S$ and the banking wall 88 all are oriented normal to the plane of the screen 85 and extend above the plane of the screen 85 a common height $h_1$ as seen in FIG. 9 greater than the maximum granular bed height as will become more apparent. The ends of the side walls $86_L$ and $86_S$ at the secondary discharge end of the deck assembly 15 are joined by a light discharge end wall 89 oriented normal to the axis $A_L$. The light discharge end wall 89 is also oriented generally normal to the plane of screen 85 but projects above the screen a height $h_2$ less than height $h_1$, usually about 1.5 inches. The height $h_2$ of light end discharge end wall 89 determines the depth of the bed of granular material at the secondary discharge end of deck assembly 15 as will become more apparent. The light end discharge end wall 89 has a length $W_1$ about equal to the width of the deck assembly 15. The length $L_1$ of side wall $86_L$ is about 1.5 times the length $W_1$ of end wall 89 as will become more apparent. Abutments 87 (FIGS. 8 and 9) extend along the inside of side walls 86 over the perforated screen 85 to prevent the particulate material from being caught along opposite edges of the perforated screen 85.

It will thus be seen that the side walls $86_L$ and $86_S$ together with light discharge end wall 89, banking wall 88 and screen 85 define an open top separating chamber 90 into which the granular material is deposited for separation. The chamber 90 has a constant width section adjacent the secondary discharge end thereof and a tapering section from the constant width section tapering to a point at the corner of the primary discharge end and discharge side of the deck assembly 15.

The corner of the deck frame 80 at the primary discharge end and offside outside of the banking wall 88 is covered by a discharge regulator housing 91 which closes the top of that corner of the deck frame 80 so that air forced up from the bottom of the deck frame 80 must pass through the perforated screen 85 into the separating chamber 90. The discharge regulator housing 91 is provided with an opening 92 as will become more apparent.

The deck assembly 15 is placed on top of the subdeck assembly 14 as seen in FIG. 1 and clamps 94 lock the deck assembly 15 on top of the subdeck assembly 14 so that the bottom of the deck assembly 15 is sealed to the top of the subdeck assembly 14. The bottom of the subdeck assembly 14 is sealed to the top of the side walls 25 and end walls 26 of housing assembly 11 with a flexible seal 95 (FIGS. 1 and 8) so that the subdeck assembly 14 and deck assembly 15 can be vibrated with respect to housing assembly 11 as will become more apparent.

The specific construction of the perforated screen 85 is best seen in FIGS. 8, 10 and 11. The perforated screen 85 is formed into a series of upstanding steps 96 integrally connected to each other in an end-to-end fashion with the steps 96 extending across the full width of the perforated screen generally normal to the axis $A_L$ of the deck assembly 15 as best seen in FIG. 8. The perforated screen 85 has a configuration corresponding generally in shape to that of the bottom of the separating chamber 90 so that the screen 85 forms the bottom of chamber 90. The discharge and off sides of screen 85 are parallel to the axis $A_L$ so that they abut the inside of side walls $86_L$ and $86_S$ while the secondary discharge end of screen 85 is normal to axis $A_L$ and abuts the light discharge end wall 89. The primary discharge end of the screen 85 is angled as the banking wall 88 but projects past the banking wall 88 under the regulator housing 91 as shown by dashed lines in FIG. 8.

Each of the steps 96 as best seen in FIGS. 10 and 11 includes an upstanding pushing leg 98 integrally joined along its upper edge with the upper edge of a shifting leg 99 to form an upper apex 100 extending across screen 85 normal to axis $A_L$. The lower edge of the pushing leg 98 is integrally joined with the lower edge of the shifting leg 99 of the adjacent step 96 to form a lower apex 101 also normal to axis $A_L$. The upper apexes 100 are seen to lie in a common upper screen plane $SP_U$ while the lower apexes lie in a common lower screen plane $SP_L$. The planes $SP_U$ and $SP_L$ are parallel to each other with the lower plane $SP_L$ coplanar with the top of the deck frame 80. That surface of the pushing leg 98 inside the separation chamber 90 faces the primary discharge end of deck assembly 12 while the shifting leg 99 angles from upper apex 100 downwardly toward the secondary discharge end of deck assembly 12 as will become more apparent. Thus, it will be seen that a material carrying recess 102 is formed on top of screen 85 between adjacent steps 96 between the pushing leg 98 on that step 96 closer to the secondary discharge end of screen 85 and the shifting leg 99 on that step 96 closer to the primary discharge end of screen 85.

Each step 96 has an effective substantially vertical height $h_3$ normal to planes $SP_L$ and $SP_U$ and an effective substantially horizontal length $L_3$ along planes $SP_L$ and $SP_U$. The height $h_3$ is selected to be substantially equal to the minimum diameter of the pieces of granular material likely to be encountered in the separator. For instance, shelled peanuts usually have a diameter range of about 0.25–0.33 inch and height $h_3$ would be selected at 0.25 inch. Unshelled peanuts usually have a minimum cross-sectional diameter of about 0.375 inch and height $h_3$ would be selected at about 0.375 inch. The pushing leg 98 defines an angle $A_8$ with plane $SP_L$ such that the pieces $P_G$ of granular material $P_G$ as seen in FIG. 10 carried in the recess 102 will remain in the recess 102 and be moved with screen 85 as the deck assembly 12 is moved toward the primary discharge end of the separator and upwardly. An angle $A_8$ of 75°–90° has been found satisfactory to insure this movement even though the air flow up through screen 85 tends to lift the granular material as will become more apparent. The shifting leg 99, on the other hand, defines an angle $A_9$ with plane $SP_L$ such that the pieces $P_G$ of granular material as seen in FIG. 10 carried in recess 102 will move up over the shifting leg 99 as the deck assembly 12 is moved toward the secondary discharge end of the separator and downwardly while air is simultaneously forced up through screen 85. An angle $A_9$ of about 15°–20° has been found satisfactory to insure this movement as will become more apparent. Thus, angle $A_9$ should be about one-fourth to one-sixth the angle $A_8$. The angle $A_9$ and height $h_3$ thus determines the length $L_3$ but it is usually about three to four times the height $h_3$. In the particular instance shown, length $L_3$ is about one inch.

The screen 85 is attached to the top of the deck frame 80 by screws 104 as seen in FIGS. 10 and 11 so that screen 85 is moved with deck assembly 12. Also, as the deck frame 80 is twisted, the screen 85 will be twisted therewith as will become more apparent.

It will be seen that the perforated screen 85 defines air passages 105 therethrough arranged in longitudinally and transversely extending rows with the air passages of each row staggered with respect to the air passages in the adjacent rows. This allows the air to pass upwardly therethrough to fluidize the bed of granular material in separating chamber 90 carried on screen 85 as will become more apparent.

A primary discharge opening 111 is provided through the longer deck side wall $86_L$ on deck assembly 15 adjacent its juncture with the banking wall 88 at the corner $C_D$ between the discharge side and primary discharge end of the deck assembly 15. The granular material in the acceptable weight range is discharged through this opening. The opening 111 is rectilinear in shape and is oriented so that its longitudinal axis extends generally parallel to the screen planes $SP_U$ and $SP_L$ as seen in FIG. 14. The opening 111 has a length $L_4$ and an effective height $h_4$ also seen in FIG. 14. The lower edge of opening 116 is located above the upper apexes 100 of screen 85 a distance $d_o$ seen in FIGS. 13 and 15 so that the granular material supported directly on screen 85 can be shifted past the opening 111 as will become more apparent while that end of the discharge opening 111 facing corner $C_D$ is located a distance $d_c$ from the corner. Thus, it will be seen that the opening 111 extends from adjacent the corner $C_D$ toward the secondary discharge end of the deck assembly 15 and is located within the depth of the bed of granular material as will become more apparent.

Figure 13:
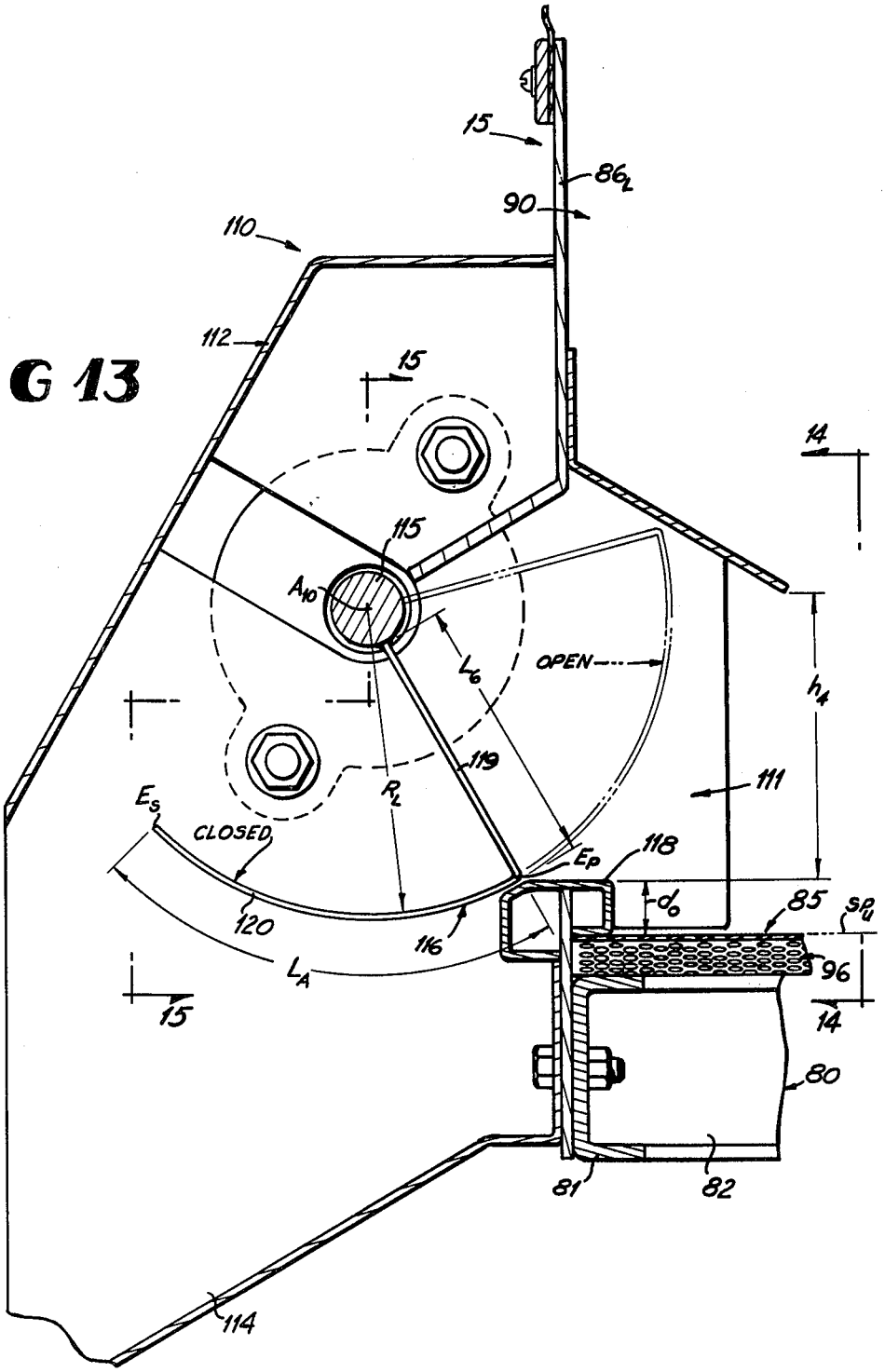
FIG. 13 is an enlarged cross-sectional view of the discharge gate assembly taken generally along line 13—13 in FIG. 8.
Figure 14:
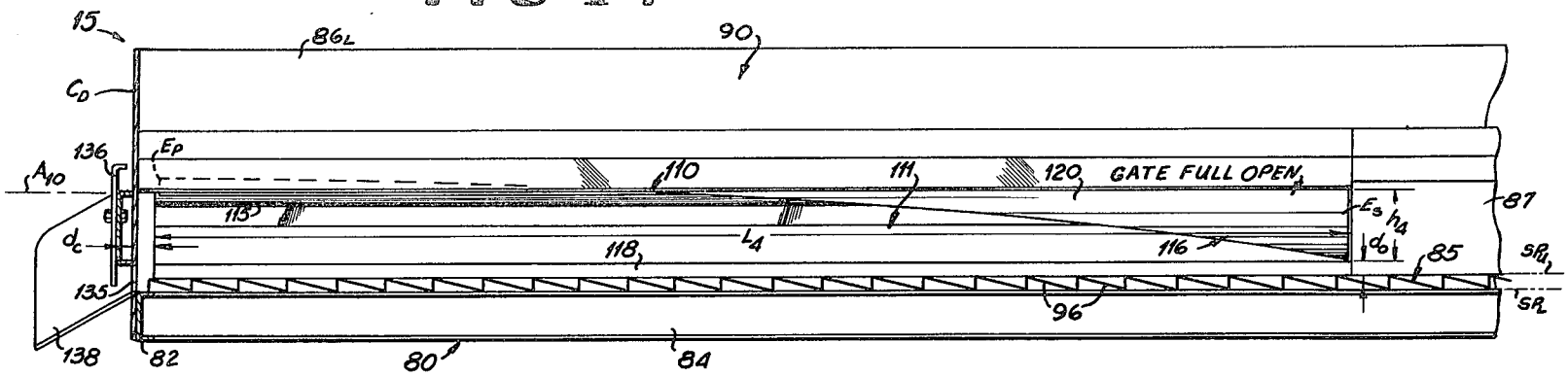
FIG. 14 is a reduced inside view of the discharge gate assembly taken generally along line 14—14 in FIG. 13.
Figure 15:
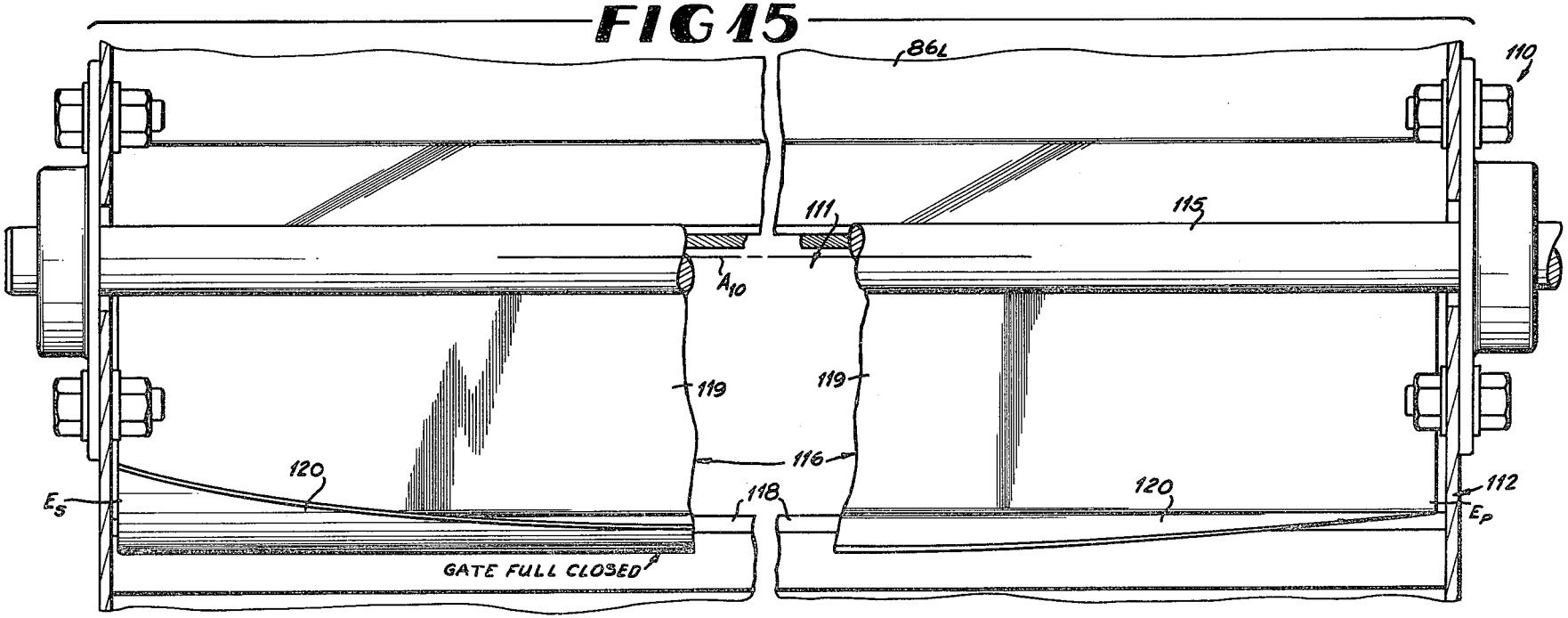
FIG. 15 is a longitudinal cross-sectional view of the discharge gate assembly taken generally along line 15—15 in FIG. 13.

A discharge gate assembly 110 is provided on the deck assembly 15 about the discharge opening 111 through the longer side wall $86_L$ as best seen in FIGS. 13–15. The discharge gate assembly 110 serves to regulate the amount of particulate material which may pass through the discharge opening 111. The discharge gate assembly 110 includes generally a gate housing 112 mounted on the outside of the deck side wall 86L about the discharge opening 111 with the gate housing 112 forming a discharge chute 114 therefrom so that the particulate material passing out of the discharge opening 111 in the side wall $86_L$ will flow out of the discharge chute 114. The discharge gate assembly 110 also includes a gate positioning shaft 115 rotatably mounted in the gate housing 112 about a pivot axis $A_{10}$ oriented parallel to the plane of the discharge opening 111 as will become more apparent.

The gate positioning shaft 115 mounts gate 116 thereon which cooperates with an abutment 118 along the bottom edge of the discharge opening 111 as best seen in FIG. 13 to selectively regulate the effective opening area in the discharge opening 111 as the gate positioning shaft 115 pivots the gate 116 about the axis $A_{10}$. It will be seen that the gate 116 includes a spacer leg 119 extending along the positioning shaft 115 as seen in FIG. 15 and oriented generally radially with respect to the shaft 115 as seen in FIG. 13. The spacer leg 119 has a length $L_6$ (FIG. 13) which is substantially equal to the distance between the gate positioning shaft 115 and the abutment 118. The gate 116 also includes an arcuate tapering section 120 integral with the outboard end of the spacer leg 119 and having a radius of curvature $R_L$ centered on the axis $A_{10}$ of the gate positioning shaft 115. The arcuate tapering section 120 has an arcuate length which tapers uniformly circumferentially outwardly from the end $E_p$ of spacer sections 120 facing corner $C_D$ to a length $L_A$ at that end $E_S$ facing the secondary discharge end of deck assembly 15 as seen in FIG. 15, the length $L_A$ being shown in FIG. 13. As the gate positioning shaft 115 is rotated counterclockwise from the closed position shown in solid lines in FIG. 13 toward the fully open position shown in phantom lines in FIG. 13, it will be seen then that the tapering section 120 forms an opening between the abutment 118 and the tapering section 120 which increases lengthwise from the primary discharge end toward the secondary discharge end of deck assembly 15 as the shaft 115 is rotated. The gate 116 is shown in its fully open position in FIG. 14 and in its fully closed position in FIG. 15. This counterclockwise rotation also serves to cause the effective opening between the arcuate tapered section 120 and the abutment 118 to be wider at the end $E_p$ than at the end $E_S$ as the gate positioning shaft 115 is pivoted. In this way, the effective opening between the gate 116 and the abutment 118 varies as the gate positioning shaft 115 is rotated counterclockwise as seen in FIG. 13 with both the height of this opening and the length of the opening changing.

Figure 3:
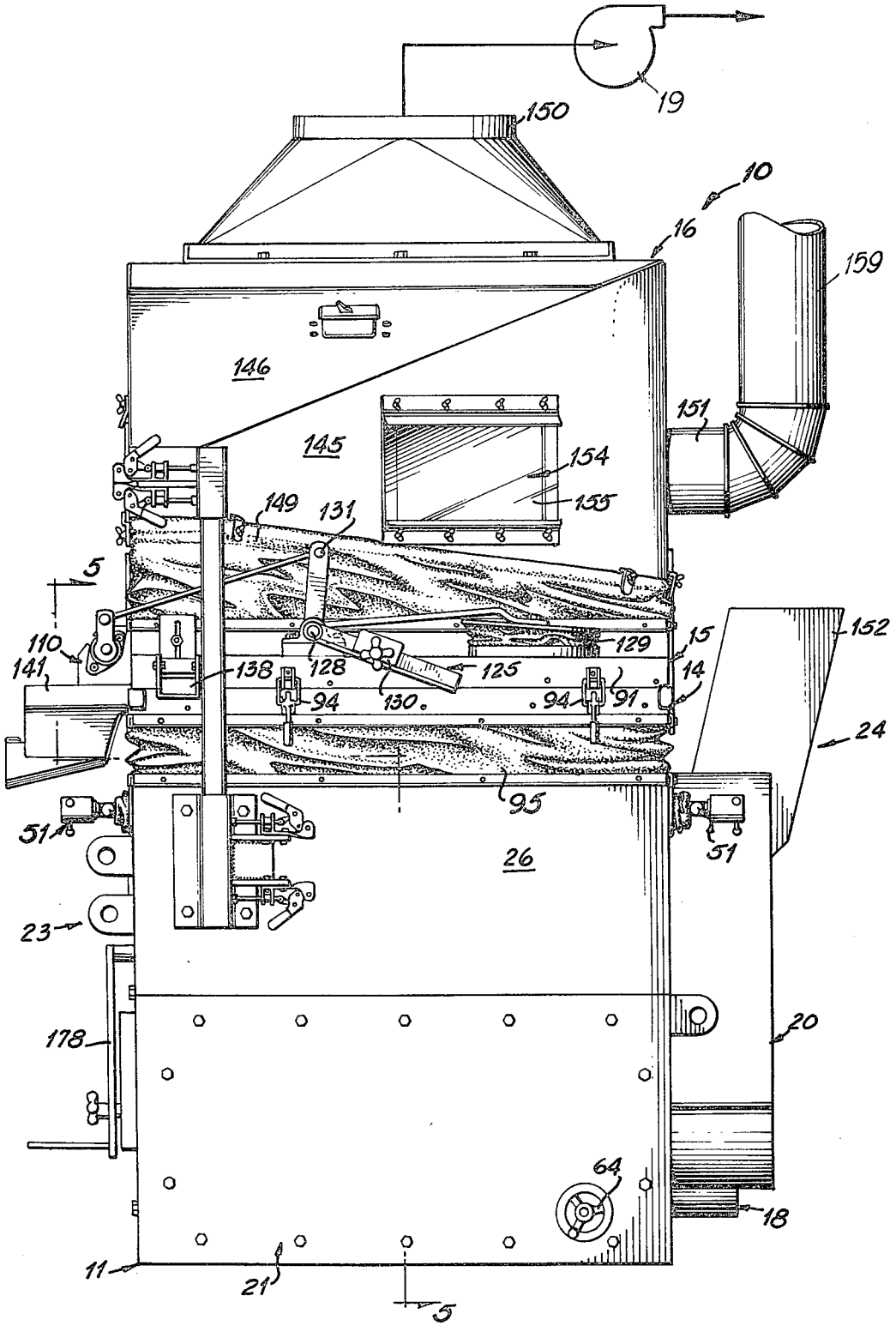
FIG. 3 is a near end view of the separator seen in FIG. 1.

For regulating the position of the gate positioning shaft 115, a pressure regulated positioning mechanism 125 best seen in FIGS. 3 and 8 is provided. The gate positioning mechanism 125 includes a pressure pickup plate 126 pivotally mounted on drive shaft 128. The pressure pickup plate 126 is connected to the opening 92 in the discharge regulator housing 91 and is sealed thereto with the flexible sealing member 129. Thus, it will be seen that the pressure pickup plate 126 will be moved away from the opening 92 as the pressure in the discharge regulator housing 91 is increased and will move toward the opening 92 as the pressure in the discharge regulator housing 91 is decreased. The drive shaft 128 is provided with an adjustable counterweight 130 so that the force at which the pressure pickup plate 126 is constantly urged toward the opening 92 can be adjusted. Linkage 131 connects the drive shaft 128 with the gate positioning shaft 115 so that, as the pressure pickup plate 126 pivots the drive shaft 128 counterclockwise as seen in FIG. 3, the gate positioning shaft 115 will likewise be pivoted counterclockwise as seen in FIGS. 3 and 13. Thus, as the pressure in the discharge regulator housing 91 increases sufficiently to move the pressure pickup plate 126 away from the opening 92, the gate positioning shaft 115 will be pivoted counterclockwise to open the gate 116. As the pressure is lowered in the discharge regulator housing 91, the pressure pickup plate 126 will rotate the drive shaft 128 clockwise thereby rotating the gate positioning shaft 115 clockwise to move the gate 116 toward closure. The linkage 131 is adjusted so that, when the pressure pickup plate 126 is in its lowermost position as seen in FIG. 3, the gate positioning shaft 115 will maintain the gate 116 in its closed position.

While the gate assembly 110 has been described as using a pivoting gate 116 where the pivoting of gate 116 toward its open position increases the effective size of the opening thereby both as to length and height, it is to be understood that different gate assembly constructions may be used to achieve the same purpose. For instance, a flat gate with an angled edge may be used where the gate is shifted generally vertically or longitudinally of the opening 111 by the positioning mechanism 125 to vary the effective opening thereby in a manner similarly to that described for gate 116.

Another discharge opening 135 seen in FIGS. 13 and 14 is provided through the lower portion of the banking wall 88 adjacent the corner $C_D$ between wall 88 and side wall $86_L$. The heavier granular material above the acceptable specific weight range is discharged through this opening 135 since this heavier material rides over the steps 96 in screen 85 under the acceptable discharge opening 111. A control gate 136 is operatively associated with the discharge opening 35 which can be manually adjusted to regulate the flow of material out of the discharge opening 135. A discharge chute 138 is also connected about the discharge opening 135 on the outside of the deck assembly 12 so that the material being discharged through the discharge opening 135 will flow out with discharge chute 138.

Figure 2:
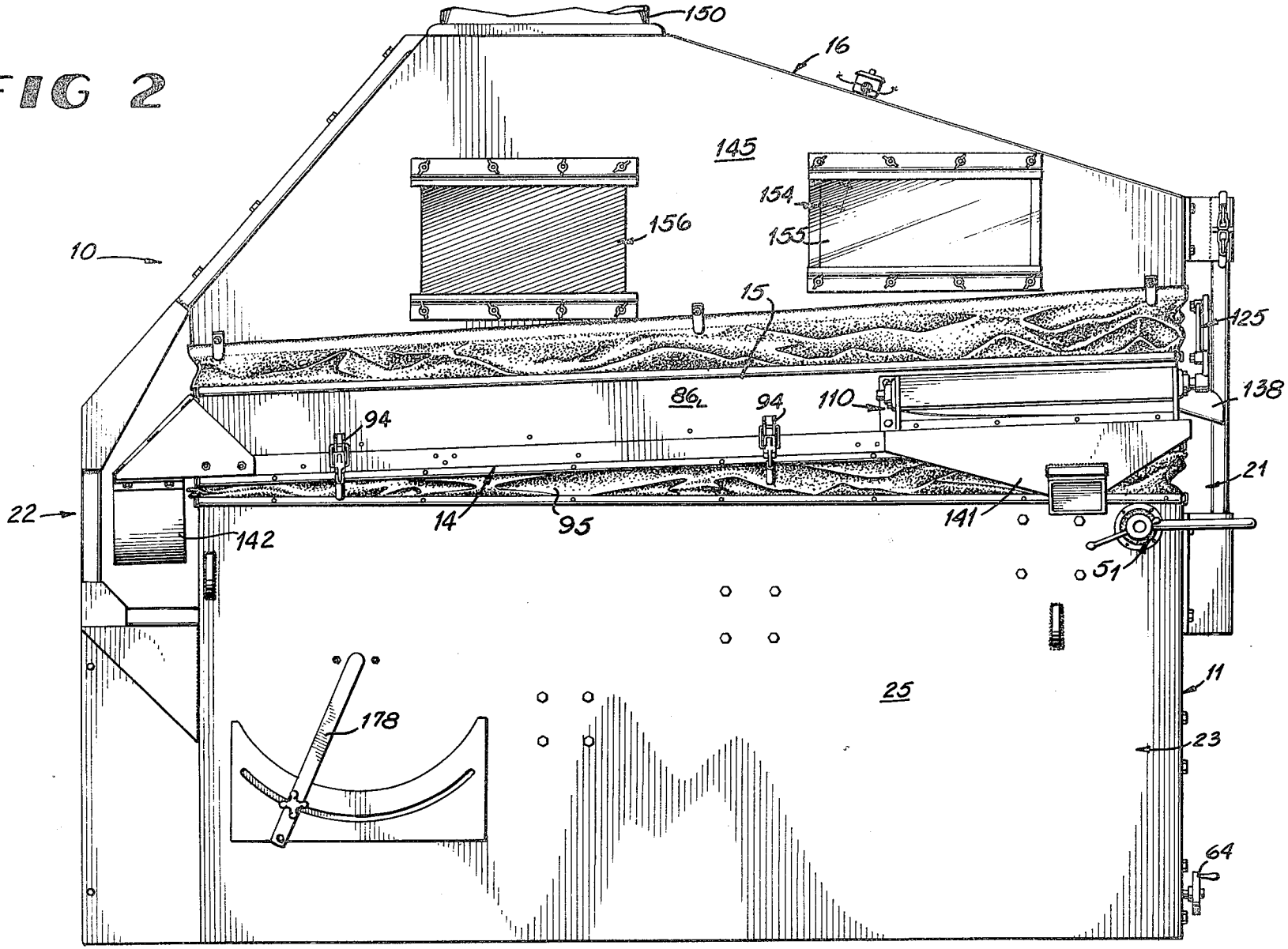
FIG. 2 is a distal side elevation view of the separator seen in FIG. 1.
Figure 4:
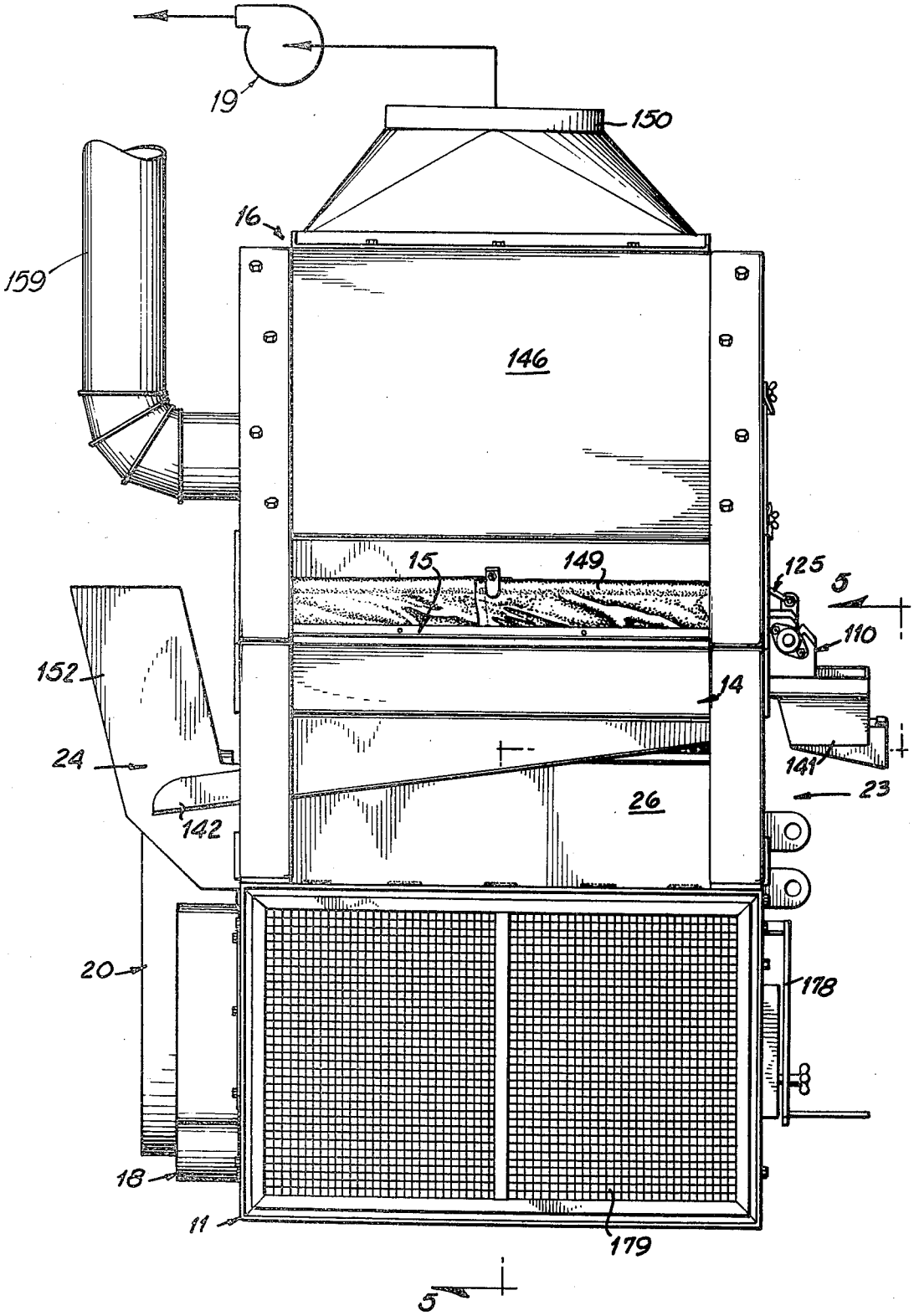
FIG. 4 is a distal end view of the separator seen in FIG. 1.

An acceptable product transfer chute 141 is mounted on subdeck assembly 14 directly below the discharge chute 114 on the discharge gate assembly as best seen in FIGS. 2 and 3 to transfer the acceptable product to appropriate material handling equipment (not shown). Likewise, a light product transfer chute 142 is provided under the light discharge end wall 89 on deck assembly 15 as best seen in FIGS. 1, 4 and 12 to catch the light product flowing over end wall 89 and transfer it to appropriate reprocessing equipment (not shown).

HOOD ASSEMBLY

The hood assembly 16 is a hollow member defining downwardly directed opening therein corresponding in shape to the upwardly directed opening in the deck assembly 12. The hood assembly 16 is formed by side walls 145 and top walls 146 to define an air receiving chamber 148 therein opening onto the bottom of the hood assembly 16. The bottom edge of the hood assembly 16 is joined to the top edge of the deck assembly 12 with a flexible sealing member 149 so that the air passing upwardly through the deck assembly 12 passes into the air receiving chamber 148 in the hood assembly 16. The top of the hood assembly 16 is provided with an air discharge pipe 150 so that the air in the air receiving chamber 148 can pass out to the atmosphere. The air discharge pipe 150 is connected to the intake of the upper fan unit 19 shown schematically in FIGS. 3 and 4 to assist in drawing air out of the air chamber 148 in the hood assembly 15 and providing better air pressure control through the deck assembly 15 as will become apparent.

The hood assembly 16 also defines viewing ports 154 through the side walls 145 which may be covered with appropriate transparent members 155 such as the glass or plastic panels illustrated in FIGS. 1 and 2. The particulate material to be separated is introduced into the deck assembly 12 via an inlet pipe 151 in one of the side walls 145 of the hood assembly 16 as seen in FIGS. 1, 3, 4 and 9. The material is usually introduced via an inlet pipe 151 from a connector 159 as seen in FIG. 9. It is to be understood, however, that the particulate material to be separated may be introduced at different locations in the hood assembly 16 or at different locations in the deck assembly 12 itself.

LOWER FAN UNIT

The lower fan unit 18 is mounted in the chamber 29 in the housing assembly 11 as seen in FIGS. 5–7. The lower fan unit 18 includes generally a centrifugal fan 165 mounted in the housing assembly 11 so that its shaft 166 is oriented generally transversely to the longitudinal axis $A_L$ of the housing assembly 11 with the fan shaft 166 rotatably journalled between the side walls 25 of the housing assembly 11. The fan shaft 166 is driven by a fan motor 168 carried by mounting in the housing assembly 11 through a belt drive 169 extending outside the housing assembly 11 as seen in FIG. 7.

A plurality of separator plates 174 extend between the housing side walls 25 to divide the chamber 29 into a lower intake air plenum 172 and an upper discharge air plenum 175 discharging out through the open top of chamber 29. The intake air plenum 172 is also partly formed by intake plenum walls 173 seen in FIGS. 5 and 7.

The discharge opening 170 from fan 165 is directed into the discharge air plenum 175 so that the air being discharged from the fan 165 will be directed out of the top of the chamber 29. The intake openings 171 of the fan 165 are located in the intake air plenum 172. An air damper 176 seen in FIGS. 5 and 7 is provided between the separator plates 174 and the intake walls 175 so as to regulate the flow of air being drawn into the fan 165 so as to regulate the air pressure above the separator plates 174. The air damper 176 is provided with an adjustment mechanism 178 located on the outside of the housing assembly 11 as seen in FIGS. 2 and 4. The intake to the air plenum 172 is provided through an appropriate filter 179 in one end of the housing assembly 11 as seen in FIG. 5 so that air is drawn into the fan 165 through the intake filter 179 and then discharged from the fan 165 into the discharge air plenum 175 above the separator plates 174. An air diffusion screen 80 may be provided under the deck assembly 15 as best seen in FIG. 8 directly above the discharge opening 170 on fan 165 to equalize the air flow through the perforated screen 85 on the deck assembly 15.

OPERATION

In operation, the separator 10 is designed to separate granular material such as shelled or unshelled peanuts into three general specific weight fractions as previously discussed. The acceptable fraction of the product within the acceptable specific weight range is discharged through the discharge gate assembly 110 as illustrated in FIG. 8, the light fraction of the product in a specific weight range lighter than the acceptable specific weight range is discharged over the light discharge end wall 89 as seen in FIG. 8 while the heavy fraction in a specific weight range heavier than the acceptable specific weight range is discharged through the discharge opening 135 also indicated in FIG. 8. Usually, the light fraction includes a mixture of partially shelled peanuts and other light debris which is returned for further processing while the heavy fraction usually is a mixture of rocks and stones as well as some of the heavier shelled peanuts. This heavy fraction is usually much smaller in quantity than the acceptable fraction. The heavy fraction is usually further processed through a machine known as the stoner that removes the rocks and stones from the peanuts and the peanuts subsequently sized for further use. The acceptable fraction usually goes directly to subsequent sizing operations for further sizing the peanuts.

As mentioned before, the subdeck assembly 14 and the deck assembly 15 carried thereon is tilted upwardly about the pivot axis $A_3$ to the angle $A_4$ seen in FIG. 5 while the primary discharge end of the subdeck assembly 14 and deck assembly 15 are tilted transversely of the longitudinal axis thereof to the angle $A_5$ as seen in FIG. 6 so that the discharge corner $C_D$ of the separating chamber 90 is usually the highest corner of the deck assembly 15. With the lower fan unit 18 blowing air upwardly through the screen member 85 in the bottom of the separating chamber 90 and the vibratory drive unit 20 vibrating the vibratory frame assembly 12, the subdeck assembly 14, and the deck assembly 15, the granular material such as shelled peanuts are discharged into the separating chamber 90 for separation. The longitudinal tilt angle $A_4$ and the transverse tilt angle $A_5$ are adjusted so that a bed B of the granular material such as shelled peanuts is formed in the separating chamber 90. This bed B is best illustrated in the schematic free-body diagram in FIG. 16 which shows the bed B after a sufficient time of operation has elapsed for the bed to form.

Figure 16:
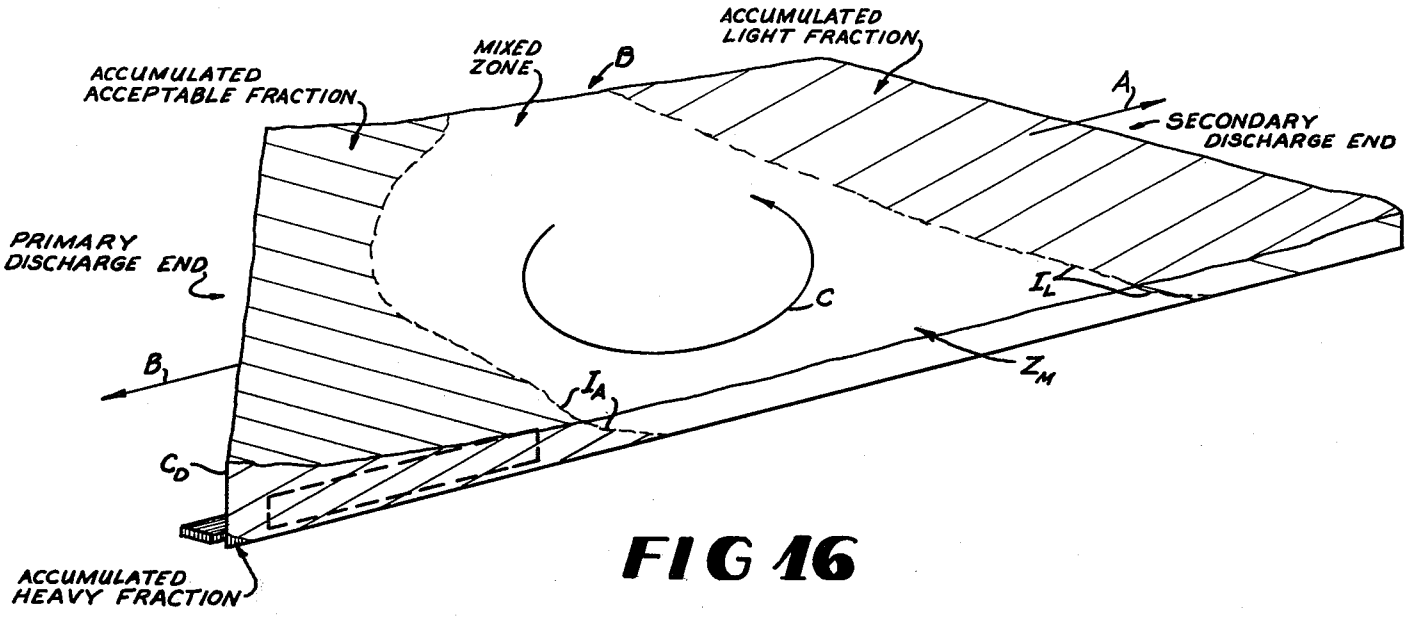
FIG. 16 is a schematic free body diagram of the bed of granular material being separated in the invention.

As seen in FIG. 16, the bed B increases in thickness from the secondary discharge end toward the primary discharge end of the bed. The upward air flow through the bed B together with the vibration of the deck assembly 15 causes the light fraction of the material to rise to the top of the bed while the heavy fraction of the material sinks to the stepped screen 85 with the acceptable fraction of material lying therebetween. The longitudinal deck tilt causes the material riding on top of the bed B to move generally axially along the bed toward the secondary end of the bed indicated by arrow A in FIG. 16 under the influence of the upward air flow through the bed and gravity while the vibratory action of the steps 96 in screen 85 causes the material on the bottom of the bed B to be moved toward the primary discharge end of the bed indicated by arrow B in FIG. 16. At the same time, the action of one of the side leaf spring assemblies 35 being at angle $A_2$ offset with respect to angle $A_1$, of the rest of the leaf spring assemblies, the action of the end leaf spring assemblies 41 and the action of the banking wall 88 set up a circulating motion in bed B as indicated by arrow C in FIG. 16.

The combination of motions within the bed B results in the light fraction of material eventually rising to the top of the bed B and moving generally toward the secondary discharge end of the bed while the acceptable and heavy fractions move generally toward the primary discharge end of the bed. This causes the light fraction of material to accumulate at the secondary discharge end of the bed B until it accumulates to the height of the light discharge end wall 89 and then starts to flow over the light discharge end wall into the light transfer chute 142 for separation. At the same time, the heavy fraction of material tends to accumulate along the bottom of the banking wall 88 and move toward the discharge corner $C_D$ of the bed B where it flows out of the heavy discharge opening 135 under the influence of control gate 136. The acceptable fraction of material in the bed B also tends to accumulate at the primary discharge end of the bed B but rides up over the heavy discharge fraction being accumulated thereat. Between the acceptable fraction of material and the light fraction of material, it will be seen that a mixed zone which has been identified as $Z_M$ in FIG. 16 is formed in which the primary separation of the fractions take place. As the material stratifies in zone $Z_M$, the light fraction rises to the top of the bed and moves to the already accumulated light fraction at the light discharge end of the bed. The heavy fraction drops to the bottom of the bed and is moved along the screen 85 under the accumulated acceptable fraction to the already accumulated heavy fraction along the banking wall 88. As the acceptable fraction in the mixed zone $Z_M$ drops toward the bottom of the bed, it is moved to the already accumulated acceptable fraction at the discharge end of the bed. This sets up an interface $I_H$ between the accumulated heavy fraction and the accumulated acceptable fraction, an interface $I_A$ between the accumulated acceptable fraction and the mixed zone $Z_M$, and an interface $I_L$ between the mixed zone $Z_M$ and the accumulated light fraction.

The motion of the deck assembly 15 also causes each of the accumulated and separated fractions to circulate within themselves. The bottom portion of each of the accumulated fractions is moving generally toward the primary discharge end of the bed while the top portion of the accumulated fraction is moving generally toward the secondary discharge end of bed B. The accumulated heavy fraction tends to increase in thickness from that end facing the secondary end of the bed B to that end along the banking wall 88 facing the primary discharge end of bed B. Likewise, the accumulated acceptable fraction tends to increase in thickness from that end facing the secondary discharge end of bed B to that end along the banking wall 88 facing the primary discharge end of bed B. The light fraction, on the other hand, tends to increase in thickness from that end facing the primary discharge end of bed B toward that end at the light discharge end wall 89 at the secondary discharge end of bed B. The interface $I_A$ angles upwardly from the bottom of bed B from that end facing the secondary discharge end of the bed to that end facing the primary discharge end of bed B.

The acceptable discharge opening 111 through the deck side wall $86_L$ is schematically shown in FIG. 16 by dashed lines in relation to bed B. The gate assembly 110 opens and closes this opening 111 in response to the pneumatic pressure below the deck assembly 15. Because the pneumatic back pressure below deck assembly 15 increases as the effective overall depth of bed B increases and because increasing pneumatic back pressure serves to increase the opening of gate assembly 110, the gate assembly 110 serves to control bed depth by varying the discharge rate of the acceptable fraction of product from bed B.

In practice, it has been found that interface $I_A$ between the acceptable fraction and mixed zone $Z_M$ is not stationary but may shift longitudinally back and forth along the bed B to a certain extent. Sometimes, this interface $I_A$ may move until it lies within that portion of the opening 111 facing the secondary discharge end of the bed B. When this occurs, the improperly separated material in the mixed zone $Z_M$ would pass out of the discharge opening 111 if the opening 111 were opened completely along its length. The operation of the gate assembly 110 is designed to prevent the inadvertent discharge of the material from the mixed zone $Z_M$ even though it may shift to a point so that it overlaps opening 111.

As the depth of the bed B increases, the air pressure below the deck assembly 15 reaches a point such that the pressure pickup plate 126 in the positioning mechanism 125 as seen in FIG. 3 is lifted from its closed position. This pivots drive shaft 128 so that the gate positioning shaft 115 is rotated counterclockwise in FIG. 13. This in turn pivots gate 116 away from its closed position as seen in FIG. 13 toward its open position. As gate 116 is so pivoted, the effective opening thereby starts at that end of the discharge opening 111 facing the discharge corner $C_D$ and increases in length toward the secondary discharge end of bed B as the gate is further opened. Likewise, the effective opening past gate 116 is always greater at that end of opening 111 nearer the discharge corner $C_D$ and tapers so that it becomes smaller in height from that end nearer the discharge corner $C_D$ toward that end facing the secondary discharge end of bed B with the bottom of the opening longer than the top. Because the accumulated acceptable fraction is always longest along its bottom and always thicker at that end nearer the primary discharge end of bed B, the effective opening past gate 116 more closely corresponds to the shape of the accumulated acceptable fraction in bed B and is most likely to always be located within the acceptable fraction to insure that only the acceptable fraction of product will be discharged past gate assembly 110. This is quite unlike the prior art pneumatically operated gate assembly which causes the gate to open completely along its length rather than from that end toward the primary discharge end of the bed B toward the secondary discharge end.

The distance $d_o$ that the bottom of the effective opening past gate 116 is located above the steps 96 on screen 85 as seen in FIG. 13 is sufficient for the heavy fraction of material to pass over steps 96 without being discharged through the opening past gate 116. Thus, even though the effective opening past gate 116 starts along the bottom of opening 111, the heavy fraction of the material passes thereby toward the primary discharge end of bed B without being inadvertently discharged.

What is claimed as invention is:

1. A separator for separating granular materials according to specific weight including:

a deck having a longitudinal axis and including a perforated screen; a first upstanding short side wall along one side of said screen parallel to the longitudinal axis; a second upstanding long side wall along the opposite side of said screen parallel to the longitudinal axis and having a length greater than said short side wall; an upstanding banking wall extending across one end of said screen between said first and second side walls and defining an obtuse angle with the longitudinal axis; and an upstanding discharge end wall extending across the opposite end of said screen between said first and second side walls oriented normal to the longitudinal axis and having a height less than said first and second side walls and said banking wall; said screen, said first and second side walls, said banking wall and said discharge end wall defining an open top separating chamber in said deck for supporting a bed of the granular material therein, said long side wall defining a first elongate discharge opening therethrough adjacent the juncture of said long side wall and said banking wall, said first discharge opening having a lower edge spaced a first prescribed distance above said screen, said banking wall defining a second discharge opening therethrough adjacent the juncture of said banking wall and said long side wall, said second discharge opening extending upwardly from said screen for a second prescribed distance less than said first prescribed distance;

a bottom air plenum below said screen in said deck and connected thereto in a sealed relationship therewith;

fan means for forcing air into said bottom air plenum so as to force air upwardly through said perforated screen and the bed of granular material carried on said screen to fluidize the bed and cause stratification of the granular material in the bed according to the specific weight thereof;

feed means for directing the granular material into the open top separating chamber to form a bed of the granular material in said separating chamber supported on top of said screen;

tilt means for adjustably tilting said deck until that end of said screen at said banking wall is higher than that end of said screen at said discharge end wall;

vibratory means for reciprocating said deck along the longitudinal axis thereof and oscillating said deck about a generally vertical axis while air is forced upwardly through said screen to separate the granular material in said separating chamber into a first fraction, a second fraction heavier than the first fraction, and a third fraction heavier than the second fraction where the third fraction settles onto said screen and is moved toward said banking wall under said first discharge opening, where the second fraction settles toward said screen and is moved toward said banking wall and where said first fraction is moved toward said discharge wall, said banking wall arresting the movement of the third fraction toward said banking wall to cause the third fraction to accumulate along said banking wall in registration with said second discharge opening, said banking wall arresting the movement of the second fraction toward said banking wall to cause the second fraction to accumulate adjacent said banking wall over the accumulated third fraction and be maintained in registration with said first discharge opening with the accumulated second fraction having a decreasing depth in a direction from said banking wall toward said discharge end wall; and pneumatic pressure operated gate means selectively covering said discharge opening so as to selectively control the flow of the granular material therethrough in response to the pneumatic pressure in said bottom air plenum, said gate means selectively varying both the effective height and effective length of said first discharge opening in response to the pneumatic pressure below said deck so that the maximum effective height of said first discharge opening is always toward that end of said first discharge opening closest to said banking wall and the effective length of said first discharge opening is increased from that end of said first discharge opening closest to said banking wall toward the other end thereof.

2. The separator of claim 1 wherein said gate means includes a gate member defining an angled edge thereon and gate positioning means responsive to the air pressure in said bottom air plenum to move said gate member with respect to the lower edge on said discharge opening so that said angled edge of said gate member effectively varies both the height of the opening and the length of the opening in response to the pneumatic pressure below said deck.

3. The separator of claim 2 wherein said gate means includes a gate positioning shaft, mounting means pivotally mounting said gate positioning shaft on said deck about a gate pivot axis generally parallel to said discharge opening; wherein said gate member includes a spacer leg mounted on said gate positioning shaft and extending outwardly therefrom, and an arcuate section integral with said spacer leg so that, as said gate positioning shaft and said gate member are pivoted about said gate pivot axis, said gate member selectively covers said discharge opening, said arcuate section defining said angled edge thereon so that, as said gate positioning shaft and said gate member are pivoted in a given direction, said angled edge on said arcuate section effectively increases the height and length of said discharge opening past said gate member, said positioning means operatively connected to said gate positioning shaft to pivot same.

4. The separator of claim 2 wherein said screen includes a plurality of steps formed therein oriented generally normal to the longitudinal axis of the screen, each of said steps including a first angled shifting leg and a second angled pushing leg integrally joined with said first angled shifting leg, said second angled pushing leg oriented so that, as said screen is moved in the direction in which the bed or granular material tends to be thicker, the pieces of granular material resting against each of said second angled pushing legs of said steps will be moved thereby in the direction in which the bed tends to be thicker without the pieces of granular material passing over said second angled pushing legs; and so that, as said screen is moved in the direction opposite the direction in which the bed of granular material tends to be thicker, the pieces of granular material resting against each of said second angled pushing legs moves away from each of said second angled pushing legs up said first angled shifting leg to the next adjacent of said steps in the direction in which the bed tends to be thicker so that said steps move the granular material resting on said screen in the direction in which the bed of granular material tends to be thicker.

5. The separator of claim 4 wherein said screen has a bottom lying generally along a lower screen plane, wherein each of said second angled pushing legs defines an included angle with the lower screen plane of about 75°–90° on that side of said second angled pushing leg facing in a direction opposite the direction in which the bed tends to be thicker, and wherein each of said first angled shifting legs defines an included angle with the lower screen plane of about 15°–20°.

6. The separator of claim 5 wherein each of said steps has an effective height extending above the lower screen plane about equal to the diameter of the granular material in that separated fraction being discharged past said discharge gate means.

7. The separator of claim 1 wherein said vibratory means includes a support frame operatively connected to said deck and having a frame longitudinal axis, a plurality of side leaf spring assemblies resiliently supporting said support frame thereon in a generally horizontal position for movement of said support frame generally along the longitudinal axis of said deck, said side leaf spring assemblies oriented so as to cause said support frame to move upwardly as said support frame is moved in a first direction along the longitudinal axis and to move downwardly as said support frame is moved in a second direction along the longitudinal axis opposite said first direction so that the given direction in which the bed tends to be thicker is in said first direction along the longitudinal axis of said support frame.

8. The separator of claim 7 wherein said vibratory means includes a plurality of end leaf spring assemblies operatively connected to said support frame to cause said support frame to rotate over a limited range of motion about the generally vertical axis as said support frame is moved generally along the longitudinal axis.

9. The separator of claim 8 wherein said tilt means includes a subdeck frame having opposed ends; pivot means pivotally connecting one end of said subdeck frame to said support frame about a subdeck pivot axis generally normal to the longitudinal axis; and positioning means operatively connecting the opposite end of said subdeck frame to said support frame to selectively pivot said subdeck frame with respect to said support frame about the subdeck pivot axis and to twist the opposite end of said subdeck frame about the longitudinal axis of said deck.

* * * * *